US010696431B2

(12) United States Patent
Lümkemann et al.

(10) Patent No.: US 10,696,431 B2
(45) Date of Patent: Jun. 30, 2020

(54) METHOD FOR PROVIDING IN A PRIMARY PACKAGING CONTAINER A DRIED SOLID PRODUCT CONTAINING AN ACTIVE PHARMACEUTICAL INGREDIENT

(71) Applicant: Hoffmann-La Roche Inc., Little Falls, NJ (US)

(72) Inventors: Jörg Lümkemann, Lörrach (DE); Hanns-Christian Mahler, Basel (CH); Sebastian Schneider, Schliengen (DE); Jörg Völkle, Murg (DE); Tobias Werk, Riehen (CH)

(73) Assignee: Hoffmann-La Roche Inc., Little Falls, NJ (US)

( * ) Notice: Subject to any disclaimer, the term of this patent is extended or adjusted under 35 U.S.C. 154(b) by 477 days.

(21) Appl. No.: 15/518,396

(22) PCT Filed: Oct. 14, 2015

(86) PCT No.: PCT/EP2015/073740
§ 371 (c)(1),
(2) Date: Apr. 11, 2017

(87) PCT Pub. No.: WO2016/059091
PCT Pub. Date: Apr. 21, 2016

(65) Prior Publication Data

US 2017/0341784 A1 Nov. 30, 2017

(30) Foreign Application Priority Data

Oct. 15, 2014 (EP) ..... 14189063

(51) Int. Cl.
*B65B 1/04* (2006.01)
*A61J 1/06* (2006.01)
(Continued)

(52) U.S. Cl.
CPC ..... *B65B 1/04* (2013.01); *A61J 1/062* (2013.01); *A61J 1/1412* (2013.01); *A61J 1/1468* (2015.05);
(Continued)

(58) Field of Classification Search
CPC ..... B65B 63/08
(Continued)

(56) References Cited

U.S. PATENT DOCUMENTS 3,696,579 A * 10/1972 Narusawa et al. ..... A61J 1/00 53/428
8,317,507 B1 11/2012 Coppeta et al.
(Continued)

FOREIGN PATENT DOCUMENTS

JP 10-328270 A 12/1998
JP 2011-524226 A 9/2011

OTHER PUBLICATIONS

Engineering Tool Box, (2005). Thermal Conductivity of Metals, Metallic Elements and Alloys. [online] Available at: https://www.engineeringtoolbox.com/thermal-conductivity-metals-d_858.html [Accessed Jul. 19, 2019]. (Year: 2019).*
(Continued)

*Primary Examiner* — Stephen F. Gerrity
(74) *Attorney, Agent, or Firm* — Mintz Levin Cohn Ferris Glovsky and Popeo, P.C.

(57) ABSTRACT

A method for providing a dried solid product containing an active pharmaceutical ingredient is disclosed and includes providing a primary packaging container, providing a drying cartridge different from the primary packaging container, the drying cartridge made of a material adapted to hold a liquid product to be dried, wherein the liquid product contains an active pharmaceutical ingredient and the drying cartridge is made of a material having a thermal conductivity higher
(Continued)

than the thermal conductivity of glass. The method also includes filling the liquid product into the drying cartridge, drying the liquid product in the drying cartridge to form a dried solid product containing the active pharmaceutical ingredient, transferring the dried solid product into the primary packaging container.

10 Claims, 5 Drawing Sheets

(51) Int. Cl.

| | |
|---|---|
| ***B65B 7/28*** | (2006.01) |
| ***B65B 3/00*** | (2006.01) |
| ***A61J 1/14*** | (2006.01) |
| ***A61J 1/20*** | (2006.01) |
| ***B65B 37/06*** | (2006.01) |
| ***B65B 63/08*** | (2006.01) |

(52) U.S. Cl.
CPC ..... *A61J 1/2089* (2013.01); *B65B 3/003* (2013.01); *B65B 7/2821* (2013.01); *B65B 37/06* (2013.01); *B65B 63/08* (2013.01)

(58) Field of Classification Search
USPC ..... 53/440, 127
See application file for complete search history.

(56) References Cited

U.S. PATENT DOCUMENTS

| | | | | |
|---|---|---|---|---|
| 2003/0100866 | A1 | 5/2003 | Reynolds | |
| 2009/0025823 | A1 | 1/2009 | Hansen | |
| 2011/0016740 | A1* | 1/2011 | Middelbeek et al. ... | A61K 9/19 34/284 |
| 2012/0074001 | A1* | 3/2012 | Genosar ..... | A61J 1/2093 206/219 |
| 2013/0064886 | A1 | 3/2013 | Coppeta et al. | |
| 2013/0302384 | A1 | 11/2013 | Hiraoka et al. | |
| 2013/0341849 | A1 | 12/2013 | Shimazaki et al. | |
| 2014/0027342 | A1 | 1/2014 | Pawlowski et al. | |
| 2014/0053952 | A1* | 2/2014 | Genosar ..... | A61J 1/2093 141/105 |
| 2015/0367022 | A1* | 12/2015 | Goessl et al. ..... | B65B 3/003 424/94.64 |

OTHER PUBLICATIONS

International Search Report dated Dec. 8, 2015 for International Application No. PCT/EP2015/073740, filed Oct. 14, 2015, 3 pages.

* cited by examiner

METHOD FOR PROVIDING IN A PRIMARY PACKAGING CONTAINER A DRIED SOLID PRODUCT CONTAINING AN ACTIVE PHARMACEUTICAL INGREDIENT

CROSS-REFERENCE TO RELATED APPLICATIONS

This application is a national stage application, filed under 35 U.S.C. § 371, of International Application No. PCT/EP2015/073740 filed on Oct. 14, 2015, which claims priority to European Patent Application No. EP 14189063.2 filed on Oct. 15, 2014, the content of which is hereby, fully incorporated by reference.

FIELD

The present invention relates to a method for providing in a primary packaging container a dried solid product containing an active pharmaceutical ingredient as specified in the independent claim.

BACKGROUND

Certain medicaments for parenteral use cannot be stably stored over extended periods of time in the liquid phase. For example, an extended period of time is to be understood to include a time interval of at least eighteen months during which the medicals are to be stored at a temperature of typically 2° C.-8° C. Such medicaments which cannot be stably stored over extended periods of time in the liquid phase are typically stored in form of a solid product comprising one or more active pharmaceutical ingredients (APIs). An active pharmaceutical ingredient is a substance in a formulation that is biologically active. For example, the active pharmaceutical ingredient causes the direct effect on the disease diagnosis, prevention, treatment or cure. A product comprises one or more active pharmaceutical ingredients (APIs) that may be for example one or more proteins, antibodies, small molecules, etc. A product may, in addition to the one or more active pharmaceutical ingredients (APIs), comprise additional non-active pharmaceutical ingredients commonly called excipients. As has been discussed above already, the liquid product may be dried to form a solid product comprising the one or more active pharmaceutical ingredient(s) (API) with or without excipients. Drying of the liquid product can be achieved by lyophilisation (freeze drying) or spray drying or any other drying method. This aspect is particularly advantageous since drying of a product comprising an API, in particular freeze drying of a product comprising an API, is a gentle process of producing a solid product comprising the API, so that the dried solid product can be stably stored separate from a liquid solvent over extended periods of time. The so obtained solid product can be stably stored, for example, in vials, syringes, cartridges or in one chamber of a dual chamber syringe/dual chamber cartridge. To reconstitute the medicament for parenteral use the solid product is solved in a liquid diluent. For example, the liquid solvent may be water for injection, saline, bacteriostatic water for injection (containing one or more preservative) or any other suitable liquid solvent (diluent).

By way of example, the syringe head of a dual chamber syringe/cartridge can be formed like a vial (i.e. a cartridge), can be formed containing a luer cone or luer slip, or can comprise a cone including a needle (staked in needle syringe). For dual chamber syringes/dual chamber cartridges a separating middle plunger is arranged between the two chambers in the syringe barrel in a sealing position in which the plunger seals the two chambers from each other. By applying pressure to a plunger rod attached to an end plunger of the dual chamber syringe/dual chamber cartridge, the end plunger is moved in a direction towards the syringe/cartridge head and applies pressure to the liquid solvent which causes the middle plunger to move from its sealing position into a bypass position in which the liquid solvent is allowed to flow into the chamber containing the solid product comprising the API. The medicament to be administered is then getting reconstituted for the subsequent administration to a patient, the administration being performed by further moving the plungers towards the syringe/cartridge head.

In the processing of dual chamber syringes/cartridges containing the dried solid product and the liquid solvent separated from each other, the separating middle plunger is typically inserted into its sealing position, before filling the liquid product containing the API through the syringe/cartridge head (limiting the syringe head to a design suitable for filling through the syringe head). The syringe barrel is then transferred into a drying chamber where the drying is formed through forced water evaporation or sublimation of the liquid product.

The time required for drying the liquid product containing the API is greatly influenced by the thermal conductivity of the material the dual chamber syringe is made of. Typically, primary packaging containers such as vials, cartridges, syringes and dual chamber syringes are made of glass or plastic materials, with all types of materials having only a poor thermal conductivity. As a consequence thereof, comparatively long time intervals are necessary to complete the drying of the liquid product containing the API in order to obtain the dried solid product. In addition, the two chambers of a dual chamber syringe/cartridge are arranged in sequence along the longitudinal extension of the syringe, thus resulting in a considerable length of the dual chamber syringe/cartridge, while the liquid product containing the API is arranged only in one of these chambers. Accordingly, while the dual chamber syringes/cartridges occupy a considerable amount of space of the drying chamber, only a small amount of the occupied space is actually utilized for drying, since the liquid product to be dried is arranged only in one chamber of the dual chamber syringe/cartridge. As a consequence, the drying chamber is inefficiently used both in terms of the time necessary to complete drying and in terms of space occupied by the dual chamber syringes/dual chamber cartridges. It is evident, that such inefficient use of the drying chamber influences the efficiency of the entire production process which is therefore open to improvement.

SUMMARY

It is therefore an object of the present invention to overcome the afore-mentioned disadvantages of the process of producing filled primary packaging containers, especially dual chamber syringes/dual chamber cartridges comprising a solid dried product and a liquid solvent, and to suggest an improved method for providing the dried solid product in such a primary packaging container (such as a vial, syringe, cartridge, dual chamber syringe or dual chamber cartridge).

To achieve this object, the present invention suggests a method for providing in a primary packaging container a dried solid product containing an active pharmaceutical ingredient, as this is specified by the features of the independent claim.

In particular, the method according to the invention comprises the steps of:

providing a primary packaging container;

providing a drying cartridge different from the primary packaging container, the drying cartridge being made of a material adapted to hold a liquid product to be dried, wherein the liquid product to be dried contains an active pharmaceutical ingredient, and wherein the drying cartridge is made of a material having a thermal conductivity which is higher than the thermal conductivity of glass;

filling the liquid product to be dried into the drying cartridge;

drying the liquid product in the drying cartridge to form a dried solid product containing the active pharmaceutical ingredient;

transferring the dried solid product from the drying cartridge into the primary packaging container.

A "primary packaging container" as used in connection with the instant invention is to be understood to mean a syringe, a cartridge, or a dual chamber syringe or dual chamber cartridge, or a vial. An "active pharmaceutical ingredient" as used in connection with the instant invention is to be understood as already discussed above, and this also holds for the terms "liquid product" and "solid product". The "thermal conductivity of glass" is known (and in particular includes a thermal conductivity of 1.05 W/mK at 25° C.). The term "drying" is to be understood to comprise lyophilisation (freeze drying) or spray drying or any other drying method suitable for drying a liquid product containing one or more active pharmaceutical ingredients (APIs).

The method according to the invention may offer a plurality of advantages: The time required to dry the liquid product containing the API can be reduced by using a separate drying cartridge (different from the primary packaging container) which can be made of a material having an excellent thermal conductivity. Also, the space occupied in the drying chamber can be significantly reduced by using a separate drying cartridge different from a syringe barrel. In particular, the length of the separate drying cartridge can be chosen substantially shorter than that of a dual chamber syringe/dual chamber cartridge, since the drying cartridge must only provide sufficient space for the liquid product to be dried. Thus, the space available in the drying chamber can be utilized more efficiently, since a considerably higher number of separate drying cartridges can be arranged in the drying chamber at the same time when compared with the rather voluminous vials/syringe barrels of dual chamber syringes/dual chamber cartridges. As the dried solid product formed in the drying cartridge has a smaller diameter than the opening of the primary packaging container, the wettable surface of the dried solid is larger compared to a process wherein the dried solid is directly formed in the primary packaging container (especially if the primary packaging is a vial). Larger wettable surfaces may lead to shorter reconstitution times at the time the dried solid product is solved in the liquid solvent to reconstitute the medicament to be administered.

In accordance with one aspect of the method according to the invention, the step of drying the liquid product to be dried is performed through lyophilizing the liquid product to be dried, and wherein the dried solid product is a lyophilisate. Lyophilizing (freeze drying) a liquid product comprising an API is a gentle process of producing a solid product comprising the API, so that the dried solid product can be stably stored separate from the liquid solvent over extended periods of time (as to the meaning of extended periods of time see above).

According to a further aspect of the method according to the invention, the drying cartridge is made of metal or a material other than metal which is compatible with the liquid product to be dried and the dried solid product. The term "compatible" in this regard is to be understood in a sense such that the material does not react with the product or components contained therein. Metals (e.g. aluminum or stainless steel) have excellent thermal conductivity and are very robust, do not break and can be easily cleaned and sterilized for being used again, so that they are particularly suitable for the production of dried solid products comprising one or more active pharmaceutical ingredients (APIs). Other materials (e.g. certain types of plastics) are particularly suitable for being used only once and are not used again. Drying cartridges made of the afore-mentioned materials can be implemented in either bulk processing (single unit processing like a regular vial processing line) or tray processing (processing a plurality of units at the same time in an array like a regular syringe processing line). Also, due to their excellent thermal conductivity the time needed for drying the liquid product containing the API can be reduced.

For example, drying cartridges made of stainless steel or aluminum have a thermal conductivity which is roughly 15-200 times better than that of a syringe barrel made of glass while at the same time these materials are robust, can be easily cleaned and sterilized for being used again, and are generally accepted in the production of medicaments.

In accordance with another aspect of the method according to the invention, the inner wall of the drying cartridge is coated with a coating material adapted for the processing of the liquid product containing the active pharmaceutical ingredient as well as for the processing of the dried solid product containing the active pharmaceutical ingredient. The inner wall coated with the coating material exhibits less friction than the uncoated inner wall of the drying cartridge when moving a plunger along the coated inner wall of the drying cartridge and/or prevents the liquid product and the dried solid product from reacting with a material the uncoated drying cartridge is made of.

This aspect is advantageous as it would allow for the use of drying cartridges made of a material which may normally not be preferred in the production of medicaments. However, the coated inner wall which is "inert" (i.e. does neither react with the liquid product to be dried nor with the dried solid product) enables the use of drying cartridges made of such materials which normally may not be preferred materials. However, even if the drying cartridge is made of a preferred material (such as the afore-mentioned materials) the coating material on the inner wall of the drying cartridge may still provide advantages in that displacement of the plunger is facilitated, and additionally the inner wall of the drying cartridge is protected by the coating.

In accordance with another advantageous aspect of the method according to the invention, the drying cartridge has a length which is at least 20% shorter than a length of the primary packaging container (e.g. the syringe barrel), and has an inner diameter which is smaller than an inner diameter of the primary packaging container (e.g. the open end of a syringe barrel).

As already mentioned, by using a drying cartridge having a length which is shorter than that of the primary packaging the space occupied in the drying chamber is reduced. Furthermore, by selecting the inner diameter of the drying cartridge to be smaller than the inner diameter of the primary packaging container (e.g. the open end of a syringe barrel or vial) a smooth transfer of the dried solid product from the drying cartridge to the primary packaging container can be achieved.

As already mentioned by selecting the inner diameter of the drying cartridge to be smaller than the inner diameter of the primary packaging container (e.g. the open end of a syringe barrel, cartridge or vial), the dried solid product has a larger wettable surface after being transferred to the primary packaging container when compared to a process where the liquid product is dried in the primary packaging container. As already mentioned, the larger wettable surface may reduce the reconstitution time of the medicament.

In accordance with a further advantageous aspect of the method according to the invention, the drying cartridge is formed as a tube having two ends, one end of the two ends being sealed by a plunger and the other end of the two ends being open. The step of transferring the dried solid product from the drying cartridge into the primary packaging container (e.g. a syringe barrel) comprises transferring the dried solid product only or the dried solid product together with the plunger through the open end of the primary packaging container into the primary packaging container (e.g. a syringe barrel).

The plunger may serve two functions. Firstly, the plunger may function as a temporary seal of one end of the drying cartridge. Secondly, after drying of the liquid product containing the API and after transfer of the dried solid product together with the plunger into the primary packaging (e.g. a syringe barrel of a dual chamber syringe), the plunger may serve as a seal (middle plunger in case of a dual chamber syringe/dual chamber cartridge) between two different chambers of a dual chamber syringe/dual chamber cartridge, or as a seal in case of a vial. For example, once the dried solid product containing the API and optionally comprising one or more other APIs and excipients has been transferred into one chamber of a dual chamber syringe/dual chamber cartridge and the plunger transferred to the syringe barrel seals this chamber, the liquid solvent can be filled into the other chamber of the dual chamber syringe/dual chamber cartridge.

In accordance with still another aspect of the method according to the invention, the step of providing a drying cartridge different from the primary packaging container comprises simultaneously providing a plurality of drying cartridges, the plurality of drying cartridges being embodied as a stripe or a plate containing a plurality of cylindrical holes. This aspect allows for the use of standard equipment (e.g. stripes or plates according to ISO 11040-7) in the production of medicaments.

In accordance with yet a further advantageous aspect of the method according to the invention, the method further comprises the steps of

- providing an adapter tube having an outer diameter smaller than the inner diameter of the primary packaging container (e.g. the open end of a syringe barrel or vial), the vent tube having an inner diameter equal to or larger than the inner diameter of the drying cartridge,
- positioning the adapter tube between the drying cartridge and the primary packaging container,
- partly inserting the adapter tube into the primary packaging container (e.g. the syringe barrel), and thereafter
- transferring the dried solid product only or the dried solid product together with the plunger from the drying cartridge through the adapter tube into the primary packaging container (e.g. syringe barrel).

The adapter tube, once inserted at least partly into the primary packaging container, protects the primary packaging container (which is typically made of glass) against breaking during the transfer of the dried solid from the drying cartridge into the primary packaging container (e.g. syringe barrel), either with or without the plunger. Additionally, the siliconization of the inner wall of the primary packaging container (e.g. syringe barrel) is not adversely affected as there is no sliding friction between the plunger and the syringe barrel during transfer of the plunger into the primary packaging container. For moving the plunger out of the drying cartridge to a predetermined position within the primary packaging container (e.g. syringe barrel), the adapter tube is first inserted into the primary packaging container. Thereafter, a piston moves the plunger and the dried solid through the drying cartridge and subsequently through the adapter tube until the plunger is in a position that corresponds to the predetermined position within the primary packaging container (e.g. syringe barrel). Thereafter, the adapter tube is pulled back while the piston retains the plunger in the predetermined (desired) position so that the plunger rests at the predetermined position within the primary packaging container. Once the vent tube is pulled back to an extent releasing the plunger, the elastic material of the plunger expands to sealingly engage the inner wall of the primary packaging container. The plunger is then arranged at the predetermined position within the primary packaging container.

In accordance with still a further advantageous aspect of the method according to the invention, the method further comprises the step of providing at least one additional drying cartridge containing an additional dried solid product and transferring the additional dried solid product from the at least one additional drying cartridge into the primary packaging container (e.g. syringe barrel).

Using an additional (separate) drying cartridge during the drying process has the advantage of allowing for a transfer of more than one piece of dried solid product into the same primary packaging container (e.g. syringe barrel). In particular, it is thus possible to transfer different dried solid products (i.e. dried solid products obtained from different liquid products), in any quantity and any combination into the same primary packaging container. It is evident that in this case it is not possible to transfer the plunger and the dried solid product from each cartridge into the primary packaging container, but rather the plunger of that drying cartridge containing the last dried solid product to be transferred into the primary packaging container is transferred together with the last dried solid product into the primary packaging container to seal the several dried solid products.

Also, the use of two or more pieces of dried solid product obtained from the liquid product containing the same API may be advantageous over the use of one single piece of dried solid product having a size corresponding to the size of the two or more pieces since the reconstitution and drying time may be further reduced using two or more pieces of dried solid product.

In accordance with a further advantageous aspect of the method according to the invention, the method further comprises the steps of:

- providing a primary packaging tray carrying a plurality of the said primary packaging containers arranged along a plurality of parallel straight lines, each line of the plurality of parallel straight lines having the same number of primary packaging containers arranged thereon in a predetermined pattern (e.g. according to ISO 11040-7);
- providing a drying tray carrying a plurality of the said drying cartridges arranged along a further plurality of parallel straight lines corresponding to the plurality of parallel straight lines of the primary packaging tray, each of the drying cartridges containing a said dried solid product;

aligning the drying cartridges arranged along a said line of the drying tray with the primary packaging containers arranged along a said corresponding line of the primary packaging tray;

simultaneously transferring the dried solid products from the drying cartridges arranged along the said line of the drying tray into the aligned primary packaging containers arranged along the said corresponding line of the primary packaging tray;

moving the drying tray and the primary packaging tray relative to each other such that the drying cartridges of another line of the drying tray and containing dried solid products are aligned with the primary packaging containers of a said line of the primary packaging tray already containing dried solid products, or with the primary packaging containers of another line of the primary packaging tray not containing dried solid products;

simultaneously transferring the dried solids from the drying cartridges of the said another line of the drying tray into the said aligned primary packaging containers of the primary packaging tray already containing transferred dried solid products, or into the said aligned primary packaging containers not containing the dried solid products;

repeating the step of moving the drying tray and the primary packaging tray relative to each other and the step of simultaneously transferring the dried solid products from the drying cartridges of the drying tray into the aligned primary packaging containers of the primary packaging tray until the dried solid products of all drying cartridges of the drying tray are transferred into the primary packaging containers of the primary packaging tray.

In accordance with this aspect of the method according to the invention, the time required for the production of large numbers of filled primary packaging containers (e.g. dual chamber syringes/dual chamber cartridges or vials) is greatly reduced by providing a primary packaging tray and a drying tray each carrying a plurality of primary packaging containers or a plurality of drying cartridges, respectively. It allows for simultaneously performing the transfer of a plurality of dried solid products with or without plunger into a corresponding plurality of primary packaging containers in a line-by-line manner as opposed to performing the transfer one-by-one. Also, the drying tray improves drying homogeneity within one batch.

BRIEF DESCRIPTION OF THE DRAWINGS

Further advantageous aspects of the method according to the invention become apparent from the following detailed description of embodiments of the invention with the aid of the drawings in which.

DETAILED DESCRIPTION

Figure 1:
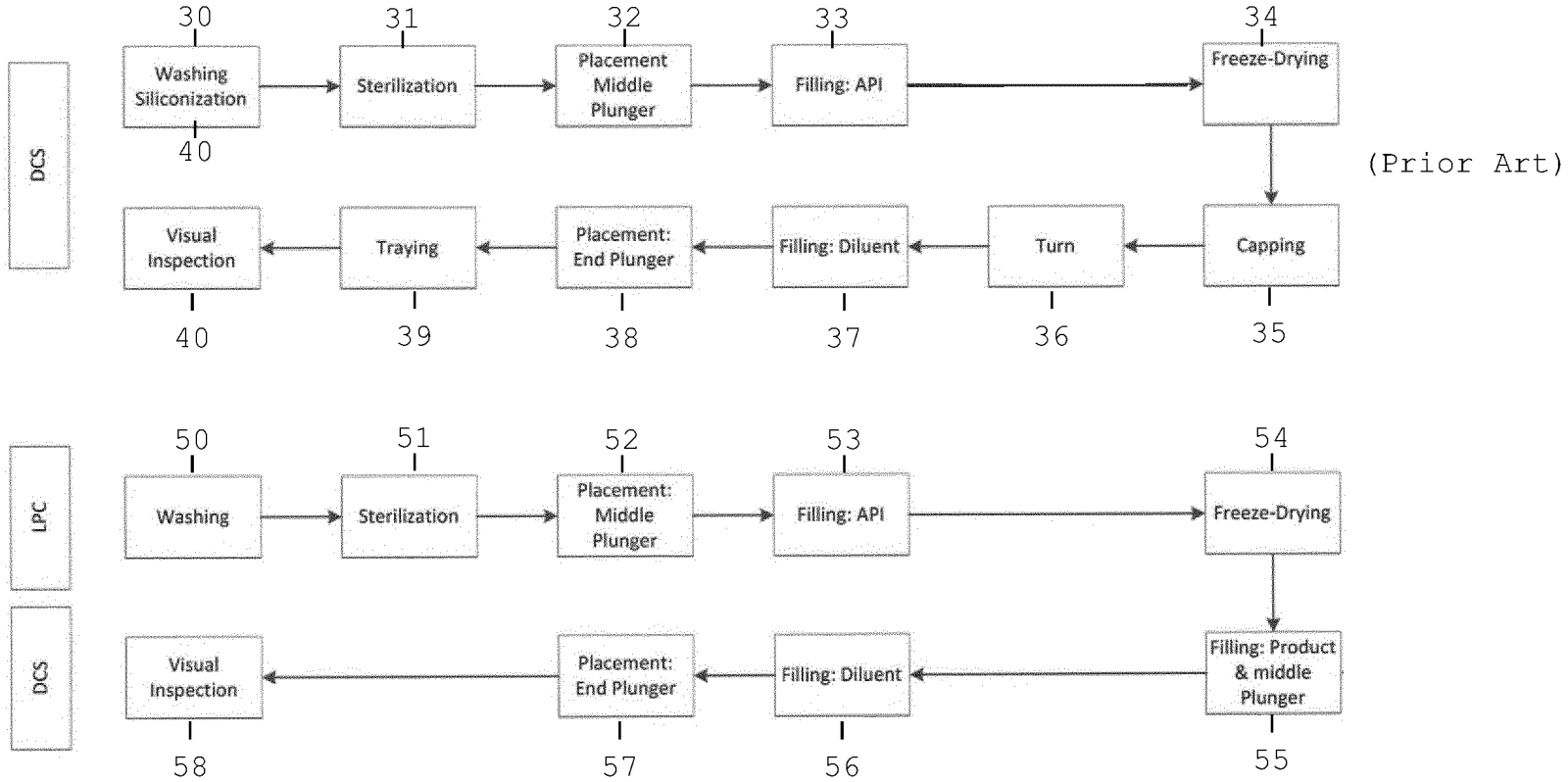
FIG. 1 shows in flow diagrams an embodiment of the method according to the invention vis-a-vis the method of the prior art.

In FIG. 1 the steps of an embodiment of the method according to the invention (lower portion of FIG. 1) vis-a-vis the method of the prior art (upper portion of FIG. 1) are shown. An essential difference between the embodiment of the method according to the invention and the method of the prior art can be immediately recognized: In the method of the prior art, all steps are carried out using a dual chamber syringe as is indicated by the box labelled "DCS" shown at the left hand side of the upper portion of FIG. 1, whereas those steps related to the production of the dried solid product are performed using a separate drying cartridge different from the dual chamber syringe as is indicated by the box labelled "LPC" at the left hand side of the lower portion of FIG. 1. Only after the dried solid product has been produced in the separate drying cartridge it is transferred from the drying cartridge into the dual chamber syringe as is evident from the box labelled "DCS" of the lower portion of FIG. 1.

The method of the prior art (see upper portion of FIG. 1) starts with the step 30 of washing and siliconizing the inner walls of the syringe barrel of the dual chamber syringe as is indicated by the box labelled "Washing, Siliconization", which is followed by a sterilization step 31 as is indicated by the box labelled "Sterilization". All steps shown in the upper row of the upper portion of FIG. 1 are typically performed with the syringe barrel being arranged in "needle-up" orientation, meaning that the syringe/cartridge head of the syringe barrel is pointing upwards. After sterilization step 31, in step 32 a plunger is inserted into the syringe barrel through the open lower end thereof to sealingly engage the inner walls of the syringe barrel as is indicated by the box labelled "Placement Middle Plunger". Next, in step 33 the liquid product containing the active pharmaceutical ingredient is filled through the syringe/cartridge head as is indicated by the box labelled "Filling: API" and is held back in the syringe/cartridge barrel by the plunger sealingly engaging the inner walls of the syringe/cartridge barrel. Thereafter, in step 34 the syringe/cartridge barrel is placed into a drying chamber of a freeze-dryer to dry the liquid product containing the active pharmaceutical ingredient through freeze-drying, as is indicated by the box labelled "Freeze-Drying". After freeze-drying (lyophilization), a dried solid product comprising the active pharmaceutical ingredient is present in the syringe/cartridge barrel.

Turning now to the lower row of the method of the prior art (still in the upper portion of FIG. 1), in the next step 35 a closure cap is placed on the syringe/cartridge head to close the syringe/cartridge head as is indicated by the box labelled "Capping". The syringe/cartridge with the closure cap is then turned upside down in step 36, so that the barrel containing the dried solid product is now arranged in a "needle down" orientation, with the syringe/cartridge head (closed by the closure cap) pointing downwards. As a consequence, the open end of the syringe/cartridge now points upwards. In the next step 37 the liquid solvent is filled into the syringe/cartridge barrel through the open end thereof, as this is indicated by the box labelled "Filling: Diluent", this open end of the syringe/cartridge barrel now pointing upwardly. In the subsequent step 38, an end plunger is inserted into the syringe/cartridge barrel through the upwardly pointing open end of the syringe/cartridge barrel as is indicated by the box labelled "Placement: End plunger", so as to seal the chamber of the syringe/cartridge barrel containing the liquid solvent. The individual syringe/cartridge barrel containing both the dried solid product comprising the active pharmaceutical ingredient and the liquid solvent is now sealed and can be arranged according to step 39 in a tray in which a plurality of such sealed syringe/cartridge barrels containing both the solid and the liquid solvent are arranged in multiple rows and columns for further processing, as is indicated by the box labelled "Traying". An inspection step 40 is to follow as indicated by the box labelled "Visual Inspection".

In contrast to the method of the prior art, as is evident from the embodiment of the method according to the invention (lower portion of FIG. 1), those steps associated with the production of the dried solid product comprising the active pharmaceutical ingredient are all performed in a separate drying cartridge different from the syringe/cartridge barrel, as will be described in more detail below. This drying cartridge can be a more or less cylindrical tube which is open at both ends and is typically made from stainless steel or aluminum, or is made of or coated on its inner wall with another material compatible with the liquid product and the dried solid product. If another material is used as the material for the syringe barrel, this other material has a high thermal conductivity (higher than the thermal conductivity of glass) and may additionally have better sliding properties than glass which the syringe barrel is typically made of. Moreover, the drying cartridge can then be made of a material for single use only, so that the drying cartridge is used only once and is then disposed of thus avoiding the risk of cross-contamination between two batches. In case the other material is used as a coating material only for the inner wall of the syringe barrel it has at least better sliding properties than glass which the syringe barrel is typically made of. Accordingly, no siliconization of the inner walls of the drying cartridge might be necessary. Rather, in a first step 50 the drying cartridge is washed only as indicated by the box labelled "Washing", whereupon in a subsequent step 51 the drying cartridge is sterilized as indicated by the box labelled "Sterilization". Thereafter, in step 52 a plunger is inserted into the drying cartridge through one end thereof to seal this end of the drying cartridge as is indicated by the box labelled "Placement: Middle Plunger". This box is labelled "Placement: Middle Plunger" since in the described embodiment of the method according to the invention, the plunger sealing the drying cartridge is transferred together with the dried solid product into the primary packaging container (e.g. syringe barrel of a dual chamber syringe/cartridge, where the plunger acts as a "middle plunger"). The sealed end of the drying cartridge is arranged pointing downwards (as described in more detail below) so that the end of the cartridge remote from the sealed end is open and is pointing upwards. Thereafter, in step 53 the liquid product containing the active pharmaceutical ingredient is filled through the upwardly pointing end into the drying cartridge as indicated by the box labelled "Filling: API". In accordance with the subsequent step 54, the drying cartridge filled with the liquid product comprising the active pharmaceutical ingredient is then placed into a drying chamber of a drying device (e.g. into the drying chamber of a freeze dryer), and the liquid product comprising the active pharmaceutical ingredient is then dried (e.g. lyophilized through freeze-drying, as this is indicated by the box labelled "Freeze-Drying") to form a dried solid product comprising the active pharmaceutical ingredient.

Before returning to FIG. 1 again and explaining the rest of the steps of the embodiment of the method according to the invention, an embodiment of the drying cartridge is now described in more detail with reference to FIG. 2*a*, FIG. 2*b* and FIG. 3.

Figure 2A:
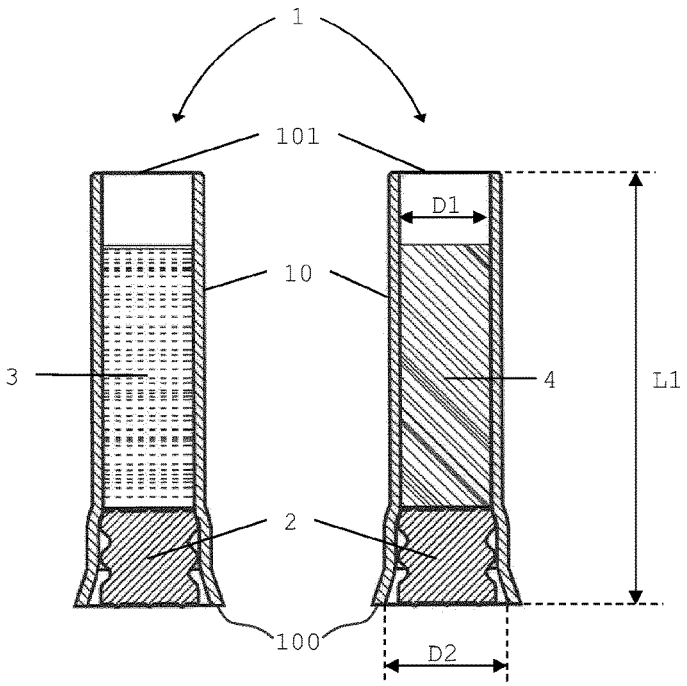
FIG. 2*a* shows an embodiment of a drying cartridge used in the method according to the invention, including a plunger sealing one end of the drying cartridge.
Figure 2B:
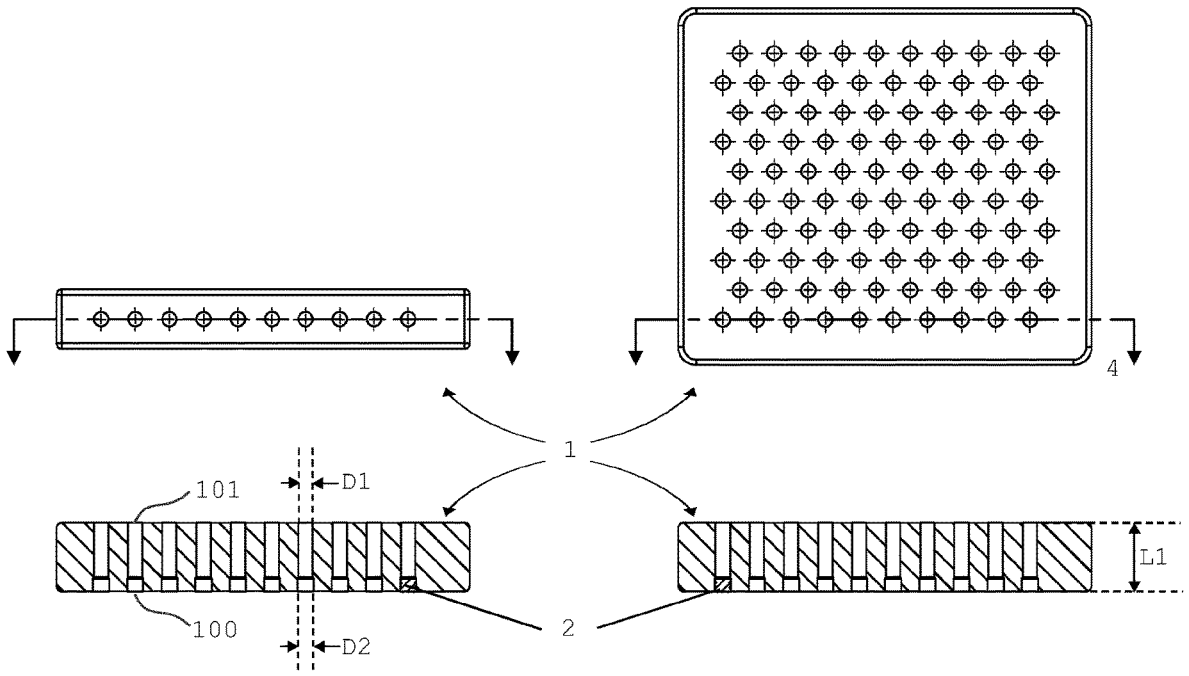
FIG. 2*b* shows stripe and plate designs of the drying cartridge used in the method according to the invention, including a plunger sealing one end of the drying cartridge.
Figure 3:
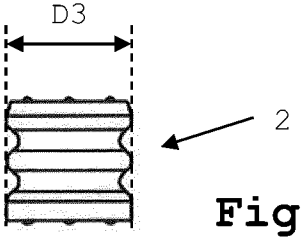
FIG. 3 shows the plunger of FIG. 2*a* and FIG. 2*b;*

As can be seen from FIG. 2*a* and FIG. 2*b*, the drying cartridge 1 comprises a more or less cylindrical tube 10 (FIG. 2*a*) or stripes or plates with more or less cylindrical bores (FIG. 2*b*) performing the function of the tube 10, the tube or the bores having a length L1 which is considerably shorter than the length of the primary packaging container (e.g. the syringe barrel). In particular, the length L1 of the tube 10 is at least 20% shorter than the length of the primary packaging container (e.g. the syringe barrel). Tube 10 is open at both ends, with the lower end 100 of tube 10 being slightly tapered (funnel-shaped) to allow for easy insertion of a displaceable plunger 2 made of an elastically deformable material, such as for example rubber. Tube 10 has an inner diameter D1 which is slightly smaller than the outer diameter D3 of plunger 2, while the inner diameter D2 at the tapered lower end 100 of tube 10 is slightly larger than the outer diameter D3 of plunger 2 (see FIG. 3), thus allowing for a smooth insertion of plunger 2 into tube 10. Once plunger 2 has been inserted into tube 10, it sealingly engages the inner wall of tube 10 (or the respective bore in the stripe or plate) while the upper end 101 of tube 10 is still open. In the left hand portion of FIG. 2*a*, drying cartridge 1 with the plunger 2 in sealing engagement with the inner wall of tube 10 is shown to contain a liquid product 3 comprising the active pharmaceutical ingredient, whereas in the right hand portion of FIG. 2*a* drying cartridge 1 is shown to contain the dried solid product 4 comprising the active pharmaceutical ingredient, obtained through e.g. freeze-drying (lyophilization) of the liquid product 3 in the drying cartridge 1. Due to the cylindrical shape of the tube 10 of the drying cartridge 1, the shape of the dried solid product is also cylindrical.

Returning to FIG. 2*a* it is immediately evident, that due to the considerably shorter length L1 of the drying cartridge 1 compared to the length of the primary packaging container, especially the length of a dual chamber syringe/cartridge the space of the drying chamber can be more efficiently used (a higher number of drying cartridges can be processed in the drying chamber simultaneously, compared to primary packaging containers, e.g. syringe barrels). In addition, since stainless steel and aluminum (the materials the tube 10 of the drying cartridge 1 is typically made of) both have a thermal conductivity which is considerably higher than that of glass (which is the material the primary packaging container is typically made of), freeze-drying (lyophilization) of the liquid product to form the dried solid product (the solid lyophilisate) requires considerably less time, thus leading to a more efficient use of the lyophilization equipment, too.

Returning to FIG. 1, once the cylindrical dried solid product 4 has been obtained through e.g. freeze-drying (lyophilization) it must be transferred from the drying cartridge 1 through the open end 101 of the drying cartridge 1 into the syringe barrel, this being performed in step 55 indicated by the box labelled "Filling: Product & middle plunger".

Figures 4A, 4B:
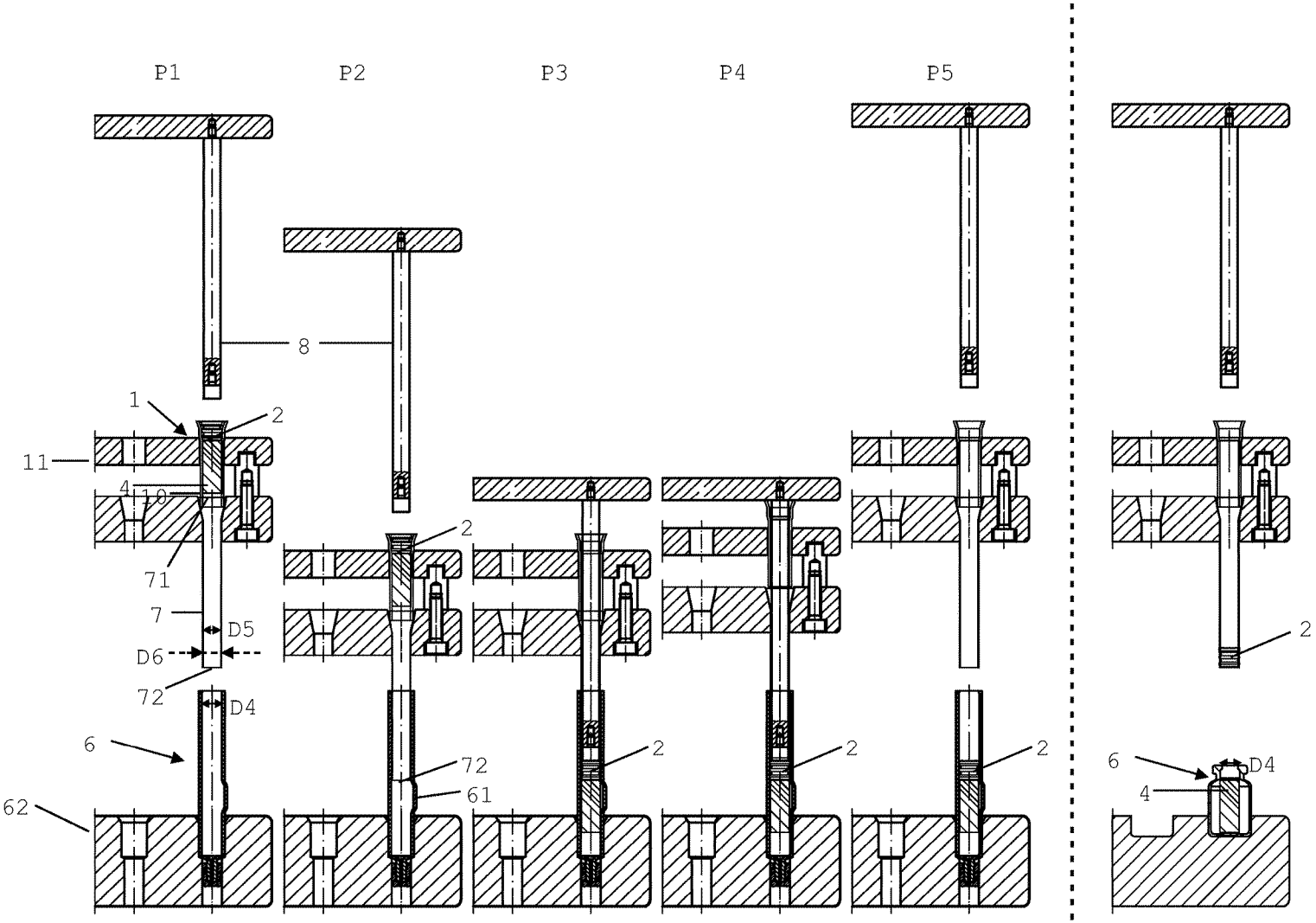
FIG. 4*a* shows different phases of the step of transferring a dried solid product together with the plunger from the drying cartridge into a syringe barrel.
FIG. 4*b* shows a vial as a primary packaging container instead of a syringe barrel shown in FIG. 4*a*.

FIG. 4*a* shows different phases P1-P5 of an embodiment how this transfer can be performed (together with the plunger 2). The transfer is performed with the aid of an adapter tube arranged between the drying cartridge 1 and a primary packaging container 6, e.g. a dual chamber syringe/dual chamber cartridge, as will be explained in more detail below. By way of example, the primary packaging container is embodied as a dual chamber syringe in FIG. 4*a* but can also be embodied as a vial as this is shown in FIG. 4*b*.

In a first phase P1 drying cartridge 1 is aligned with adapter tube 7 and primary packaging container 6. Drying cartridge 1 contains the dried solid product 4 comprising the active pharmaceutical ingredient. Adapter tube 7 has a generally cylindrical shape with an inlet end 71 and a cylindrical outlet end 72. Adapter tube 7 has an inner diameter D5 which is equal to or slightly larger than the inner diameter D1 of tube 10 of the drying cartridge 1 to allow for a smooth transfer of the dried solid product 4 out of the drying cartridge 1 through the adapter tube 7 and into the primary packaging container 6, as will be explained in more detail below. Adapter tube 7 further has an outer diameter D6 which is slightly smaller than the inner diameter D4 of the primary packaging container 6 to allow for insertion of the adapter tube 7 into the primary packaging container 6, as will also be explained in more detail below. Adapter tube 7 is made of a material which on one hand allows the plunger 2 to be conveniently pushed through the adapter tube 7 while at the same time being capable of protecting a lubricant possibly present on the inner wall of the primary packaging container 6 during the transfer of the dried solid product 4 together with the plunger 2 into the primary packaging container 6. For example, adapter tube 7 can be made of any suitable material—typically stainless steel. As can be seen, the open end 101 of tube 10 of the drying cartridge 1 is centered at the inlet end 71 of the adapter tube 7. A piston 8 is arranged near the end 100 of the tube 10 of drying cartridge 1 which is sealed by the plunger 2.

In a second phase P2, the drying cartridge 1 and the adapter tube 7 are lowered so that the adapter tube 7 is partly inserted into the primary packaging container 6 such that the outlet end 72 of the adapter tube 7 is arranged at a position at a predetermined position (e.g. above a bypass 61 formed in the wall of the primary packaging container 6 embodied as a syringe barrel of a dual chamber syringe). This is the predetermined position where the plunger 2 is to be arranged in the primary packaging container 6 after transfer of the plunger 2 together with the dried solid product 4 into the primary packaging container 6 has been completed, as this will be explained in more detail below. The partly inserted adapter tube 7 protects the lubricant that possibly may be present on the inner wall of the primary packaging container and protects the inner wall of the primary packaging container itself during the transfer, so that the glass of the primary packaging container 6 cannot easily get broken during transfer of the dried solid product 4 and the plunger 2.

In a third phase P3, piston 8 is moved downwardly pushing the plunger 2 downwards thereby also pushing the dried solid product 4 downwards through the adapter tube 7. Piston 8 is moved downwardly until the lower end of the plunger 2 is arranged flush with the lower end 72 of the adapter tube 7, so that the plunger 2 is arranged at the predetermined position in the primary packaging container 6, with the plunger 2 still being arranged inside the adapter tube. At that time, the dried solid product 4 has already been pushed into the primary packaging container 6.

In a fourth phase P4, the drying cartridge 1 and the adapter tube 7 are moved upwardly again while piston 8 remains in its position, so that the adapter tube 7 releases the plunger 2 which—upon being released—sealingly engages the inner wall of the primary packaging container 6 at the predetermined position 61 (e.g. above the bypass 61 when using a dual chamber syringe/cartridge).

Transfer of the dried solid product 4 and the plunger 2 is now complete and the piston 8, the adapter tube 7 and the drying cartridge 1 can be completely moved upwardly, this being shown in phase P5. It is evident, that in the described embodiment the plunger 2 acts as middle plunger in case the primary packaging container is embodied as a dual chamber syringe/cartridge, since it sealingly engages the inner wall of primary packaging container 6, thus forming a further chamber within the primary packaging 6 above the plunger 2 into which further chamber the liquid solvent (diluent) can then be filled. However, it is not mandatory that the plunger 2 also be transferred together with the dried solid product 4. For example, if the plunger 2 is not suitable to act as a middle plunger of the dual chamber syringe for any reason or no plunger is needed (e.g. in case the primary packaging is a vial or the primary packaging is a dual chamber syringe but will be filled with more than one dried solid product), phase P4 can be skipped so that the plunger 2 is then still arranged inside the adapter tube 7. The adapter tube 7 can then be removed together with the plunger 2, and in a separate step a middle plunger can be inserted into the dual chamber syringe/cartridge, or a stopper can be inserted into the vial. However, it is evident that the transfer of the dried solid product 4 together with the plunger 2 into a primary packaging container is particularly effective, since in this case the steps of inserting a sealing plunger into the primary packaging container and transferring the dried solid product into the primary packaging container can be performed together in a single step, thus rendering this embodiment of the method particularly efficient.

FIG. 4*b* shows that a vial can be used as primary packaging container 6 in the various phases P1-P5 shown in FIG. 4*a* (as is evident, instead of placing a middle plunger into the dual chamber syringe/cartridge a stopper is inserted into the vial).

Returning again to FIG. 1 (lower portion), after the dried solid product 4 and the plunger 2 have been transferred into the syringe barrel in step 55, in a subsequent step 56 a liquid solvent is filled into the further chamber of the dual chamber syringe/cartridge 6 formed above the plunger 2 (see FIG. 4*a*) as is indicated in FIG. 1 by the box labelled "Filling: Diluent". In a subsequent step 57, an end plunger is inserted into the syringe barrel as is indicated by the box labelled "Placement: End Plunger". An inspection step 58 is to follow as indicated by the box labelled "Visual Inspection".

The syringe barrel of the dual chamber syringe (representing the primary packaging container 6) is now sealed and contains both the dried solid product 4 comprising the active pharmaceutical ingredient and the liquid solvent, however, they are stored in different chambers of the syringe barrel which are sealed from each other. It is evident, that reconstitution of the solution (the medicament for parenteral use) can be achieved by moving the end plunger towards the syringe head of the syringe barrel causing the liquid solvent to push the plunger 2 towards the delivery end, thereby opening the bypass 61 and allowing the liquid solvent to flow through the bypass 61 into the chamber where the dried solid product 4 is stored. The dried solid product 4 comprising the active pharmaceutical ingredient is then solved in the liquid solvent and the solution to be injected (embodying the medicament for parenteral use) is thus getting reconstituted.

Figure 5:
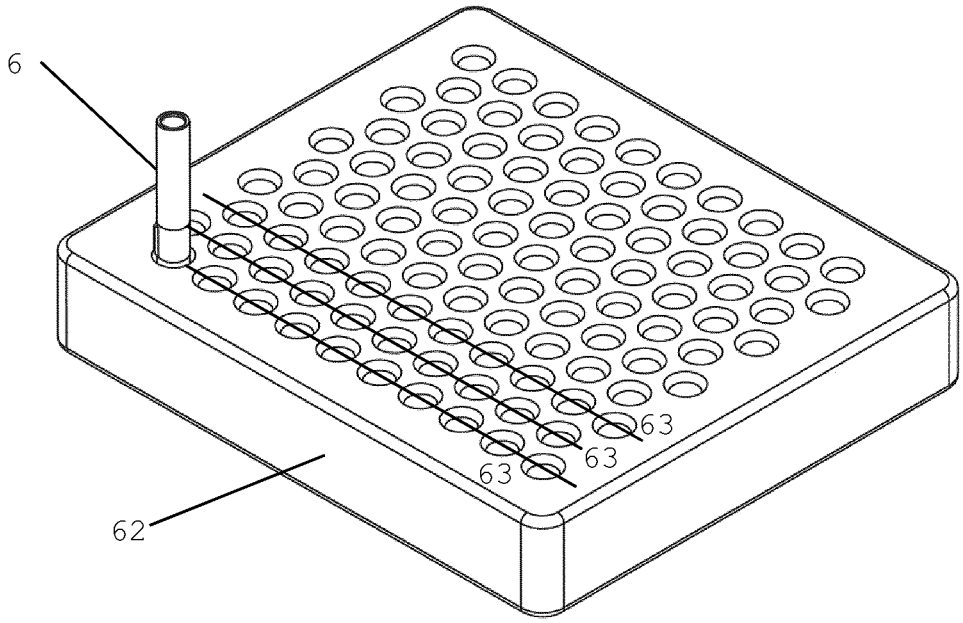
FIG. 5 shows a syringe tray for holding a plurality of syringe barrels arranged thereon in a predetermined pattern along a plurality of parallel straight lines (e.g. according to ISO 11040-7).

FIG. 5 shows a primary packaging tray 62 holding one syringe barrel representing the primary packaging container 6. During the production process, the tray 62 is completely loaded with primary packaging containers 6 arranged along multiple parallel straight lines 63, e.g. according to ISO 11040-7 (although only one syringe barrel is shown in FIG. 5 for the sake of simplicity). Primary packaging tray 62 is carrying the same number of primary packaging containers 6 along the straight lines 63. The drying tray 11, which is depicted in cross-section in FIG. 4*a*, is very similar and is carrying drying cartridges 1 arranged in the same manner as are the primary packaging containers 6 in the primary packaging tray 62. Each of the drying cartridges 1 contains a dried solid product 4. The further processing of the primary packaging is analog to phases P1 through P5 as shown in FIG. 4*a*, but it is done line by line, i.e. all the dried solid products 4 contained in one line of drying cartridges 1 are simultaneously transferred together with the plungers 2 into a corresponding line 63 of primary packaging containers 6.

The processing of the primary packaging containers using trays comprises an additional phase (not shown) which follows phase P5. During this additional phase, the primary packaging tray 62 and the drying tray 11 are moved relative to each other, for example perpendicular to lines 63, in order to align another line of drying cartridges 1 containing dried solid products 4 with either the same or another line 63 of primary packaging containers 6.

In the first case, where a new line of drying cartridges 1 has been aligned with the same line 63 of primary packaging containers 6, obviously a further dried solid product 4 is to be transferred into a primary packaging container 6 already containing a dried solid product 4 according to phases P1 through P5. This 'first case' can be repeated in any predetermined number to transfer any number of identical or different dried solid products 4, possibly even coming from a different drying tray 11, into the same primary packaging container 6. This can be achieved by skipping phase P4 and leaving the plunger 2 within the adapter tube 7 during the transfer of the dried solid product. As is evident, only after the last one of the predetermined number of same or different dried solid products 4 has been transferred into the same primary packaging container 6, the plunger 2 may be transferred into the primary packaging container 6 to seal the chamber containing the dried solid products 4.

In the second case, where a new line of drying cartridges 1 has been aligned with a new line 63 of primary packaging containers 6, obviously a first dried solid product 4 is to be transferred into an empty primary packaging container 6, either together with the plunger 2 (if only one dried solid product 4 has to be transferred into the primary packaging container 6) or without the plunger 2 if more than one dried solid product 4 has to be transferred into one and the same primary packaging container 6.

Phases P1 through P5 (and the additional phase explained above) are repeated until the dried solid products 4 of all drying cartridges 1 of the drying tray 11 have been transferred into the primary packaging containers 6 of the primary packaging tray 62.

While embodiments of the invention have been described with the aid of the drawings, it is evident that these embodiments have been described by way of example only. It is apparent to those skilled in the art that various changes and modifications can be made without departing from the teaching of the present invention. Thus, it is intended that such modifications and variations are within the scope of the appended claims.

The invention claimed is:

1. A method for providing in a primary packaging container a dried solid product containing an active pharmaceutical ingredient, the method comprising the following steps:

providing a primary packaging container;

providing a drying cartridge different from the primary packaging container, the drying cartridge being made of a material adapted to hold a liquid product to be dried, wherein the liquid product to be dried contains an active pharmaceutical ingredient, and wherein the drying cartridge is made of a material having a thermal conductivity which is higher than the thermal conductivity of glass;

filling the liquid product to be dried into the drying cartridge;

drying the liquid product in the drying cartridge to form a dried solid product containing the active pharmaceutical ingredient;

transferring the dried solid product from the drying cartridge into the primary packaging container;

providing an adapter tube having an outer diameter (D6) smaller than the inner diameter (D4) of the primary packaging container, the adapter tube having an inner diameter (D5) equal to or larger than the inner diameter (D1) of the drying cartridge;

positioning the adapter tube between the drying cartridge and the primary packaging container;

partly inserting the adapter tube into the primary packaging container; and thereafter transferring the dried solid product only or the dried solid product together with a plunger from the drying cartridge through the adapter tube into the primary packaging container.

2. The method of claim 1, wherein the step of drying the liquid product to be dried is performed through lyophilizing the liquid product to be dried, and wherein the dried solid product is a lyophilisate.

3. The method of claim 1, wherein the drying cartridge is made of metal or a material other than metal which is compatible with the liquid product to be dried and the dried solid product.

4. The method of claim 1, wherein the drying cartridge is used only once for the drying of a said liquid product and is not reused.

5. The method of claim 1, wherein the drying cartridge has a length (L1) which is at least 20% shorter than a length of the primary packaging container and has an inner diameter (D1) which is smaller than an inner diameter (D4) of the primary packaging container.

6. The method of claim 1, wherein the drying cartridge is a tube having two ends, one end of the two ends being sealed by a plunger and the other end of the two ends being open, and wherein the step of transferring the dried solid product from the drying cartridge into the primary packaging container comprises transferring the dried solid product only or the dried solid product together with the plunger through the open end of the tube into the primary packaging container.

7. The method of claim 1, wherein the step of providing a drying cartridge different from the primary packaging container comprises simultaneously providing a plurality of drying cartridges, the plurality of drying cartridges being embodied as a stripe or a plate containing a plurality of cylindrical holes.

8. The method of claim 1, further comprising the steps of:

providing at least one additional drying cartridge containing an additional dried solid product and transferring the additional dried solid product from the at least one additional drying cartridge into the primary packaging container.

9. The method of claim 1, further comprising the steps of:

providing a primary packaging tray carrying a plurality of the said primary packaging containers arranged along a plurality of parallel straight lines, each line of the plurality of parallel straight lines having the same number of primary packaging containers arranged thereon in a predetermined pattern;

providing a drying tray carrying a plurality of the said drying cartridges arranged along a further plurality of parallel straight lines corresponding to the plurality of parallel straight lines of the primary packaging tray, each of the drying cartridges-containing a said dried solid product;

aligning the drying cartridges arranged along a said line of the drying tray with the primary packaging containers arranged along a said corresponding line of the primary packaging tray;

simultaneously transferring the dried solid products from the drying cartridges of the said line of the drying tray into the aligned primary packaging containers of the said corresponding line of the primary packaging tray;

moving the drying tray and the primary packaging tray relative to each other such that the drying cartridges of another line of the drying tray and containing dried solid products are aligned with the primary packaging containers of a said line of the primary packaging tray already containing transferred dried solid products, or with the primary packaging containers of another line of the primary packaging tray not containing dried solid products;

simultaneously transferring the dried solid products from the drying cartridges of the said another line of the drying tray into the said aligned primary packaging containers of the primary packaging tray already containing transferred dried solid products, or into the said aligned primary packaging containers not containing dried solid products; and repeating the step of moving the drying tray and the primary packaging tray relative to each other and the step of simultaneously transferring the dried solid products from the drying cartridges of the drying tray into the aligned primary packaging containers of the primary packaging tray until the dried solid products of all drying cartridges of the drying tray are transferred into the primary packaging containers of the primary packaging tray.

10. The method of claim 1, wherein an inner wall of the drying cartridge is coated with a coating material adapted for the processing of the liquid product containing the active pharmaceutical ingredient as well as for the processing of the dried solid product containing the active pharmaceutical ingredient, the inner wall coated with the coating material exhibiting less friction than the uncoated inner wall of the drying cartridge when moving a plunger along the coated inner wall of the drying cartridge and/or preventing the liquid product and the dried solid product from reacting with a material the uncoated drying cartridge is made of.

* * * * *